US008037609B2

(12) United States Patent
Nicoll

(10) Patent No.: US 8,037,609 B2
(45) Date of Patent: Oct. 18, 2011

(54) RAZOR HAVING A WING SHAPED CONTOURING SHAVING AID

(75) Inventor: Roy Nicoll, Wokingham (GB)

(73) Assignee: The Gillette Company, Boston, MA (US)

( * ) Notice: Subject to any disclaimer, the term of this patent is extended or adjusted under 35 U.S.C. 154(b) by 292 days.

(21) Appl. No.: 12/041,176

(22) Filed: Mar. 3, 2008

(65) Prior Publication Data

US 2008/0209734 A1 Sep. 4, 2008

Related U.S. Application Data

(60) Provisional application No. 60/904,560, filed on Mar. 2, 2007.

(51) Int. Cl.
*B26B 19/40* (2006.01)

(52) U.S. Cl. ..... 30/59; 30/40; 30/51; 30/77

(58) Field of Classification Search ..... 30/34.2, 30/47, 51, 58, 59, 60.5, 526–533, 537–540, 30/40, 50, 70, 77, 78
See application file for complete search history.

(56) References Cited

U.S. PATENT DOCUMENTS

| | | | | |
|---|---|---|---|---|
| 1,923,439 | A * | 8/1933 | Hukill | 30/50 |
| 2,198,531 | A * | 4/1940 | Fulenwider | 30/34.2 |
| 2,677,883 | A * | 5/1954 | Schallgruber | 30/41 |
| 3,935,639 | A | 2/1976 | Terry et al. | |
| 3,969,817 | A * | 7/1976 | DiBuono | 30/41 |
| 4,403,414 | A | 9/1983 | Kiraly | |
| 4,562,644 | A * | 1/1986 | Hitchens | 30/41 |
| 4,944,090 | A * | 7/1990 | Sumnall | 30/41 |
| 5,056,222 | A * | 10/1991 | Miller et al. | 30/77 |
| 5,113,585 | A | 5/1992 | Rogers et al. | |
| 5,454,164 | A | 10/1995 | Yin et al. | |
| 5,661,907 | A | 9/1997 | Apprille, Jr. | |
| 5,855,071 | A | 1/1999 | Apprille, Jr. et al. | |
| 5,956,851 | A | 9/1999 | Apprille, Jr. et al. | |
| 6,052,903 | A | 4/2000 | Metcalf et al. | |
| 6,216,345 | B1 * | 4/2001 | Andrews | 30/50 |
| 6,311,400 | B1 * | 11/2001 | Hawes et al. | 30/527 |
| 6,584,690 | B2 | 7/2003 | Orloff et al. | |
| 7,197,825 | B2 * | 4/2007 | Walker et al. | 30/77 |
| 7,703,361 | B2 | 4/2010 | Johnson et al. | |
| 2006/0080837 | A1 * | 4/2006 | Johnson et al. | 30/50 |
| 2006/0080838 | A1 | 4/2006 | John et al. | |
| 2006/0236546 | A1 | 10/2006 | Johnson et al. | |
| 2007/0110703 | A1 | 5/2007 | O'Grady et al. | |
| 2008/0250646 | A1 * | 10/2008 | Nakasuka | 30/41 |

FOREIGN PATENT DOCUMENTS

| | | | |
|---|---|---|---|
| EP | 203527 | A1 | 5/1986 |
| GB | 1460732 | | 1/1977 |
| WO | WO 89/10245 | A1 | 11/1989 |

* cited by examiner

*Primary Examiner* — Edward Landrum
(74) *Attorney, Agent, or Firm* — Austin P. Wang; Kevin C. Johnson; Steven C. Miller

(57) ABSTRACT

Shaving razors and cartridges intended for mounting on such shaving razors wherein the cartridges include one or mounted solid shaving aid portions that are wing shaped and that exhibit an improved conformation to a shaving consumer's skin surface.

16 Claims, 10 Drawing Sheets

RAZOR HAVING A WING SHAPED CONTOURING SHAVING AID

CROSS REFERENCE TO RELATED APPLICATION(S)

This application claims the benefit of U.S. Provisional Application No. 60/904,560, filed Mar. 2, 2007.

FIELD OF THE INVENTION

This invention relates to shaving razors and cartridges intended for mounting on such shaving razors wherein the cartridges include a mounted solid shaving aid that is wing shaped and that exhibits an improved conformation to a shaving consumer's skin surface.

BACKGROUND OF THE INVENTION

Razors for wet shaving typically include a blade unit carried by a handle, the blade unit including an elongate blade with a rectilinear sharpened edge, or a plurality of such blades with parallel edges. The blade unit may be fixedly mounted on the handle with the intention that the entire razor be discarded when the blade edge or edges have become dulled. Alternatively, the blade unit can be detachably connected to the handle to enable replacement of a used blade unit with a fresh blade unit. Replaceable blade units are commonly referred to as cartridges.

Some shavers, in particular women, use this type of razor in the shower. For example, when shaving her legs a woman will often apply a film or lather of soap to an area of skin to be shaved, shave that area, apply soap to another area, and shave that area. This process is repeated until shaving is complete. Shaving in this manner may be difficult and frustrating, as it generally requires the shaver to hold a wet bar of soap in one hand while wielding a razor in the other hand, often while standing in an awkward position on a slippery shower floor.

Attempts have been made to address this problem by providing soap mounted on a razor. For example, U.S. Pat. No. 6,584,690 describes a razor that carries a shaving preparation, e.g., in the form of a solid cake of soap that surrounds the cartridge. Copending U.S. patent applications Ser. Nos. 11/471,903, 10/969,392, and 11/595,490 also relate to razor products that provide a shave preparation material to the skin's surface while shaving.

There still remains a need, however, to satisfy the needs of sophisticated shaving consumers that desire a razor product that not only applies a shaving aid to the skin during the shaving experience but also one that provides an improved conformation to the uneven surface of the skin to be shaved.

SUMMARY OF THE INVENTION

The present invention features razor cartridges and razors including such razor cartridges where the cartridges deliver a shaving aid to a user's skin during shaving. In one aspect, the invention features a shaving razor comprising:

a. a handle having a proximate and distal end;
b. a disposable razor cartridge mounted at the proximate end of said handle, said cartridge further comprising
  1) a blade unit comprising a razor blade;
  2) a shaving aid holder joined to said blade unit, said holder comprising said housing having front and rear edges;
    a) a housing surrounding said blade unit, said housing having front and rear edges;

b) a central support joined to one or both of said front and rear edges of said housing;
    c) a right wing and a left wing, both wings being flexibly joined to said central support; and
    wherein said holder carries at least one solid shaving aid portion and wherein said right and left wings exhibit biased movement in a z-direction in response to an applied pressure in the z-direction.

The foregoing aspect may include one or more of the following embodiments. Said cartridge can be removably mounted to said handle. Said shaving aid holder can be joined to said housing by the central support at a location selected from the group consisting of: 1) before said front edge and 2) after said rear edge. Said shaving aid holder comprises a central support joined to each of said front and rear edges of said housing. Said cartridge comprises a plurality of blades. Each of said wings can be joined to said central support via a biased hinge. Said biased hinges are biased toward a top surface of said cartridge. Said biased hinges can be integrally formed with said central support and a wing. Said biased hinges comprise springs. Said biased hinges comprise an elastomeric material to promote biasing. Said central support can be flexibly joined to one or both of said front and rear edges of said housing. Said holder carries a solid shaving aid portion at both the front and rear edges. Said solid shaving aid portion at the front edge can be different from said solid shaving aid portion at the rear edge. Said solid shaving aid portions at the front and rear edges do not fully surround the housing. The shaving razor may also include an additional central support that can be flexibly joined to said housing while the central support is fixedly joined to said housing.

In another aspect, the invention relates to a disposable razor cartridge comprising a. a blade unit comprising a razor blade;
b. a shaving aid holder joined to said blade unit, said holder comprising said housing having front and rear edges;
  1) a housing surrounding said blade unit, said housing having front and rear edges;
  2) a central support joined to one or both of said front and rear edges of said housing;
  3) a right wing and a left wing, both wings being flexibly joined to said central support; and
  wherein said holder carries at least one solid shaving aid portion and wherein said right and left wings exhibit biased movement in a z-direction in response to an applied pressure in the z-direction.

In an even further aspect, the invention relates to a method of shaving hair from skin comprising the steps of:

a. contacting a surface of the skin with a disposable razor cartridge comprising
  1) a blade unit comprising a razor blade;
  2) a shaving aid holder joined to said blade unit, said holder comprising said housing having front and rear edges;
    a) a housing surrounding said blade unit, said housing having front and rear edges;
    b a central support joined to one or both of said front and rear edges of said housing;
    c) a right wing and a left wing, both wings being flexibly joined to said central support; and
    wherein said holder carries at least one solid shaving aid portion and wherein said right and left wings exhibit biased movement in a z-direction in response to an applied pressure in the z-direction;

b. applying pressure in the z-direction to the surface of the skin; and c. moving said razor cartridge along the surface of the skin.

The foregoing aspect may also include the step of wetting the surface of the skin prior to contacting the surface of the skin with the razor cartridge.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1A:
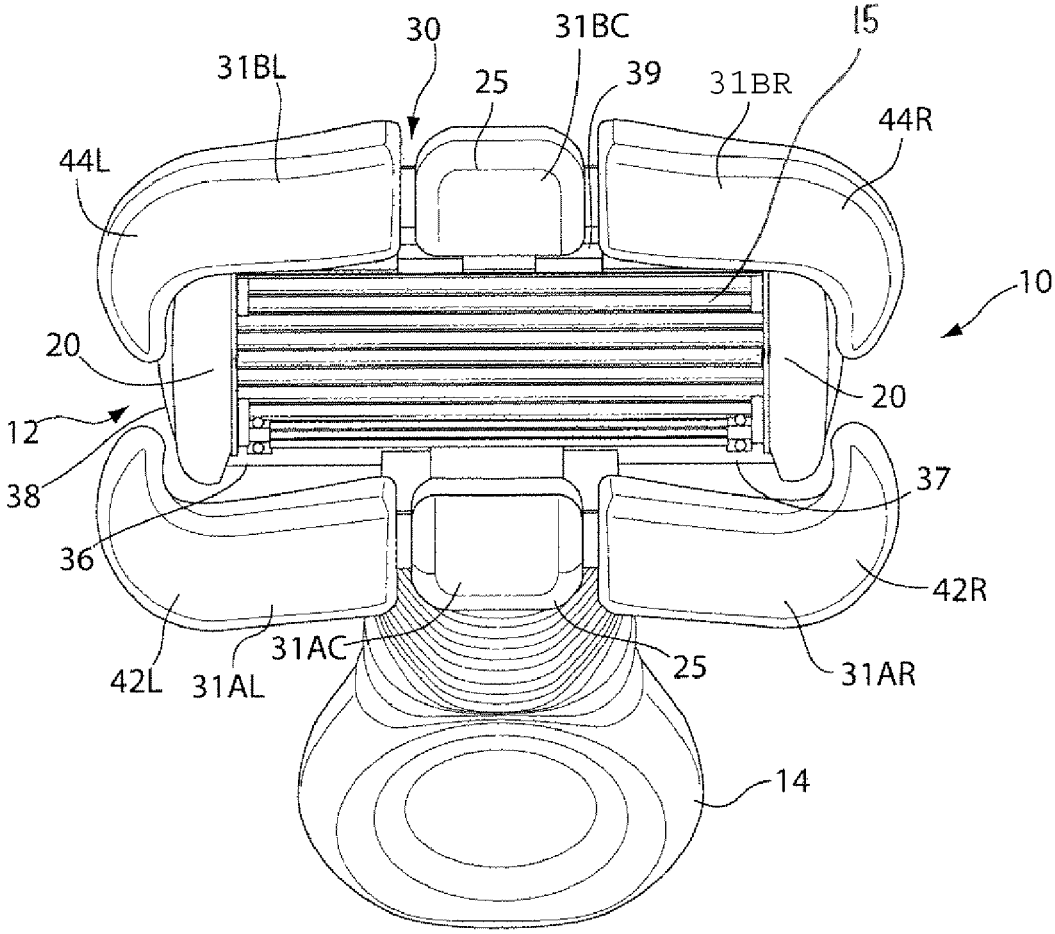
FIG. 1A is a top plan view of the cartridge and a handle portion of a razor according to one embodiment of the invention.
Figure 1B:
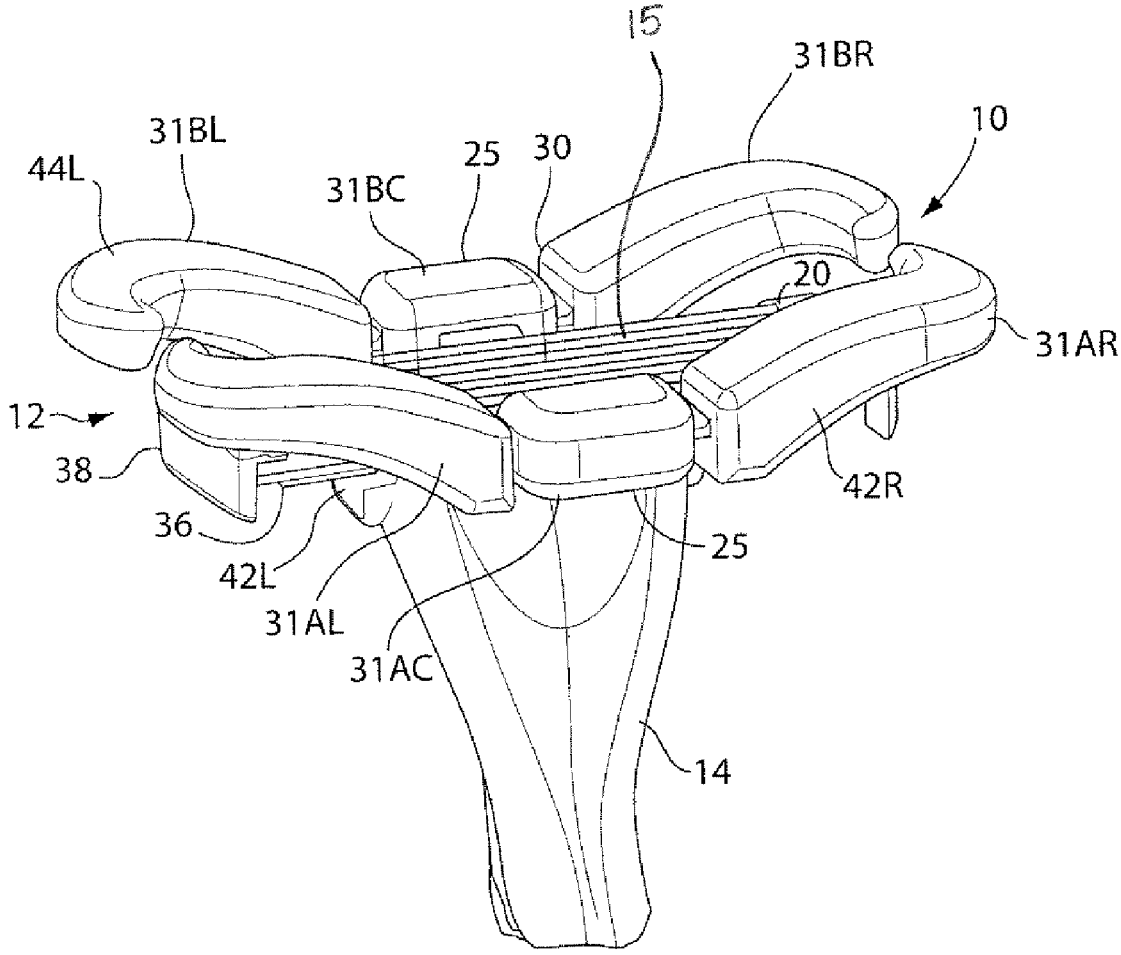
FIG. 1B is a front side view of the cartridge and a handle portion of a razor according to one embodiment of the invention.
Figure 1C:
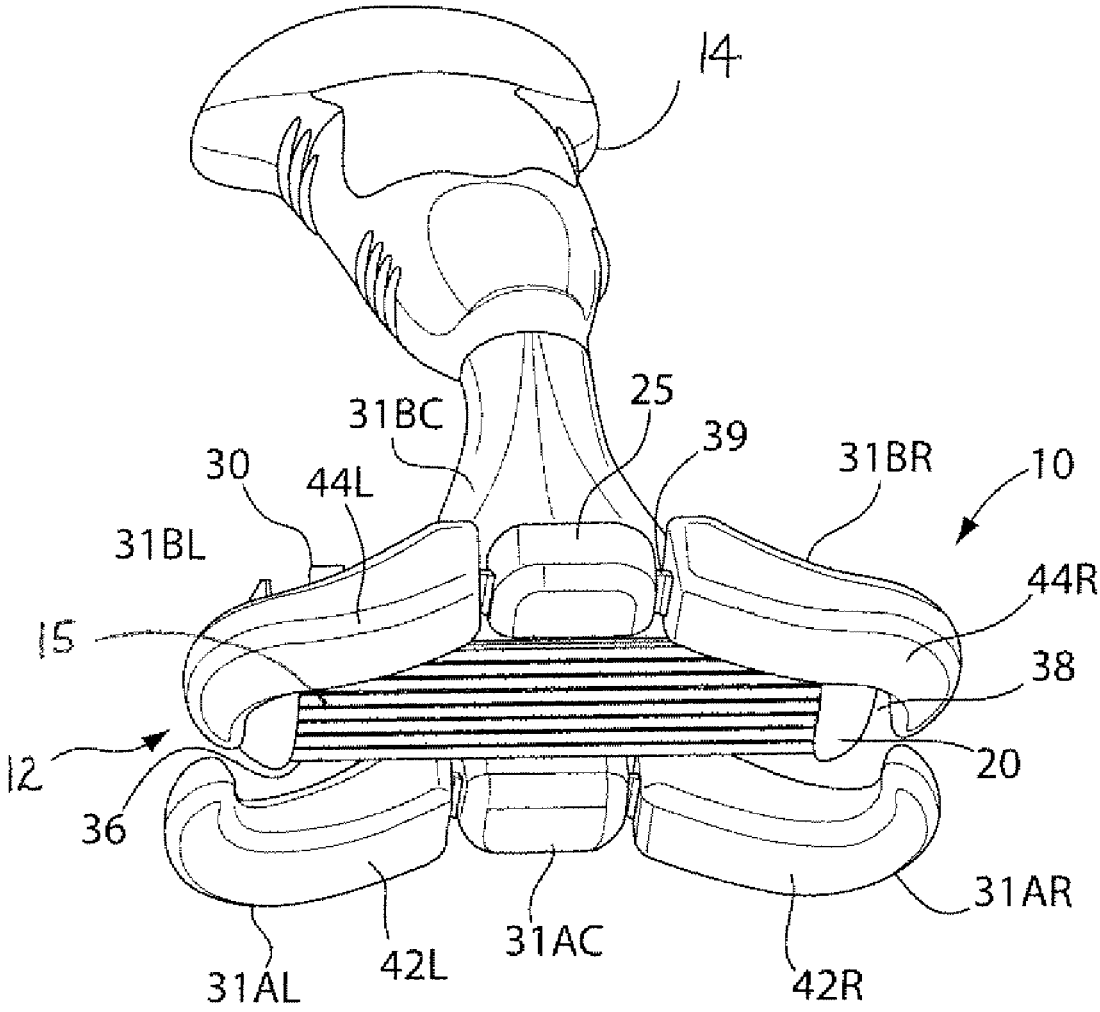
FIG. 1C is a top perspective view of the cartridge and a handle portion of a razor according to one embodiment of the invention.
Figure 1D:
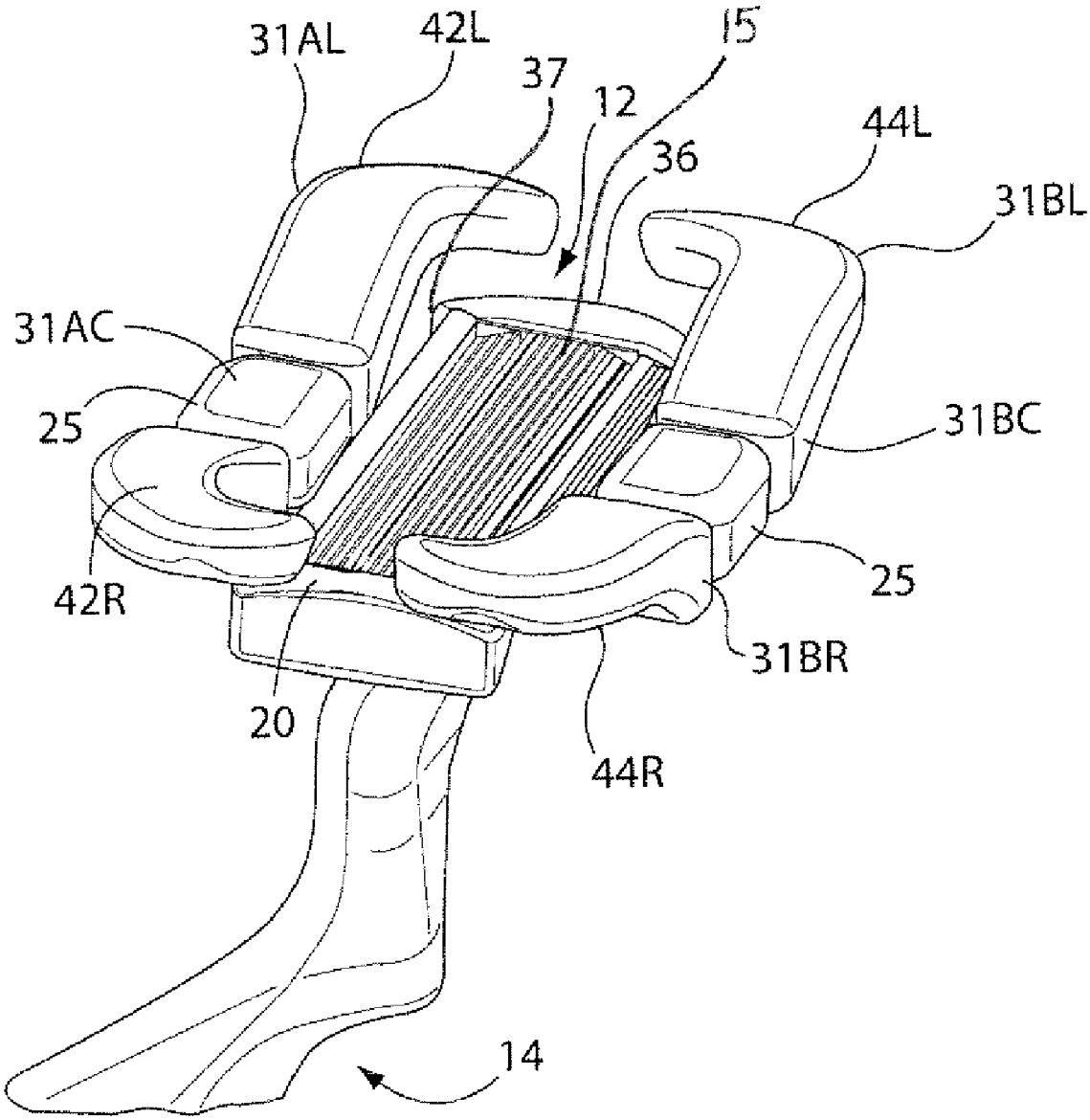
FIG. 1D is a side view of the cartridge and a handle portion of a razor according to one embodiment of the invention.

The present invention is directed to a razor that is able to provide improved conformation to the surface of the skin by exhibiting biased movement in a z-direction along a y-axis of the razor product. This mechanism of this biased movement in the z-direction along the y-axis (which extends from a top edge to a bottom edge, both of a cartridge of the present invention). The top edge runs parallel to and is outboard of the below mentioned rear edge while the bottom edge runs parallel and is outboard of a front edge. Referring to FIGS. 1A-1D, a shaving razor 10 includes a disposable razor cartridge 12 and a handle 14. Cartridge 12 includes a blade unit 20 having a razor blade 15, a shaving aid holder 30 comprising a housing 36. This housing 36 surrounds the blade unit 20 such that the housing 36 has a front edge 37 and a rear edge 39. The housing 36 also has two opposing side edges 38 disposed perpendicular to the front and rear edges. The housing 36 of the shaving aid holder 30 is attached (either permanently or removably) to the blade unit 20 by front clips 32 and rear clips 34 (specifically shown in FIGS. 3A, 3B, and 3C).

Figure 2:
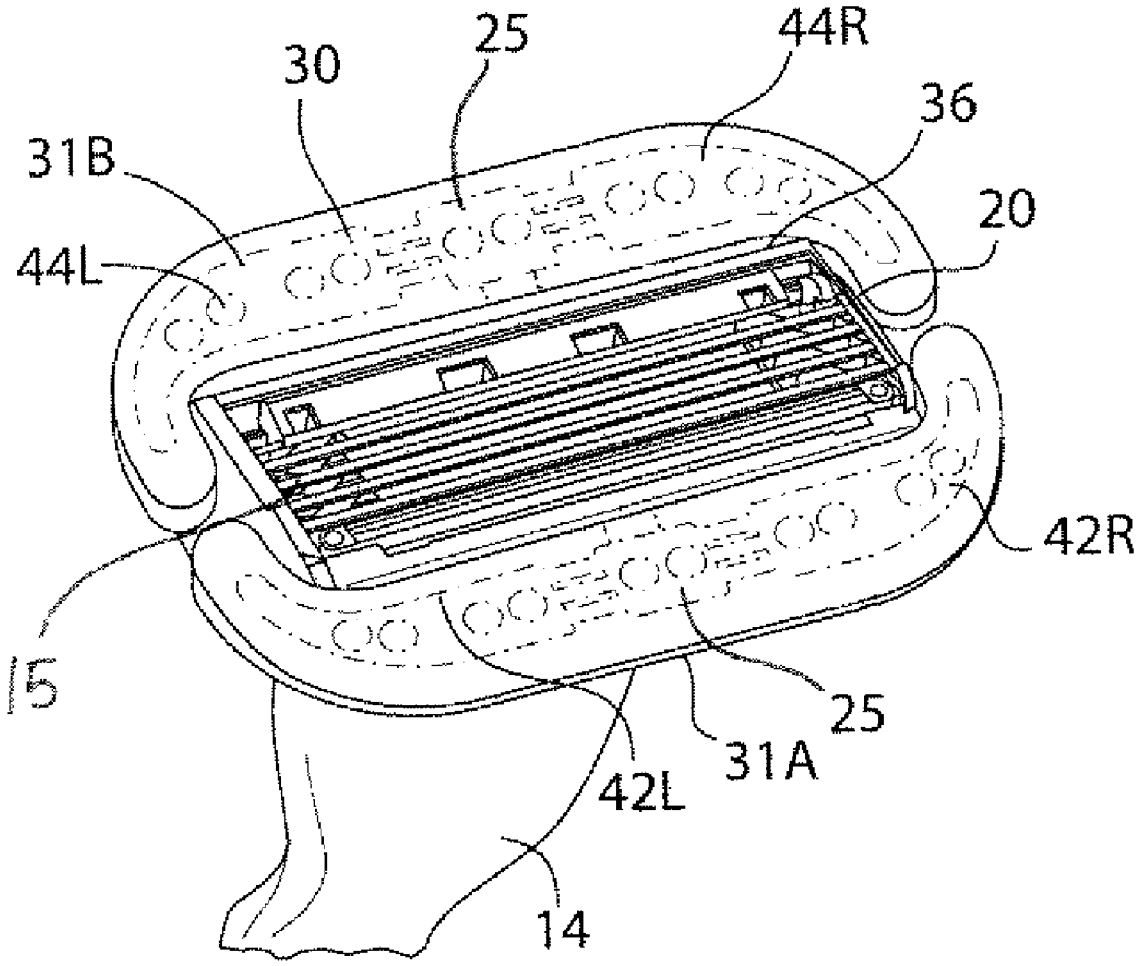
FIG. 2 is a perspective view of the cartridge and a handle portion of a razor according to another embodiment of the invention.
Figure 3A:
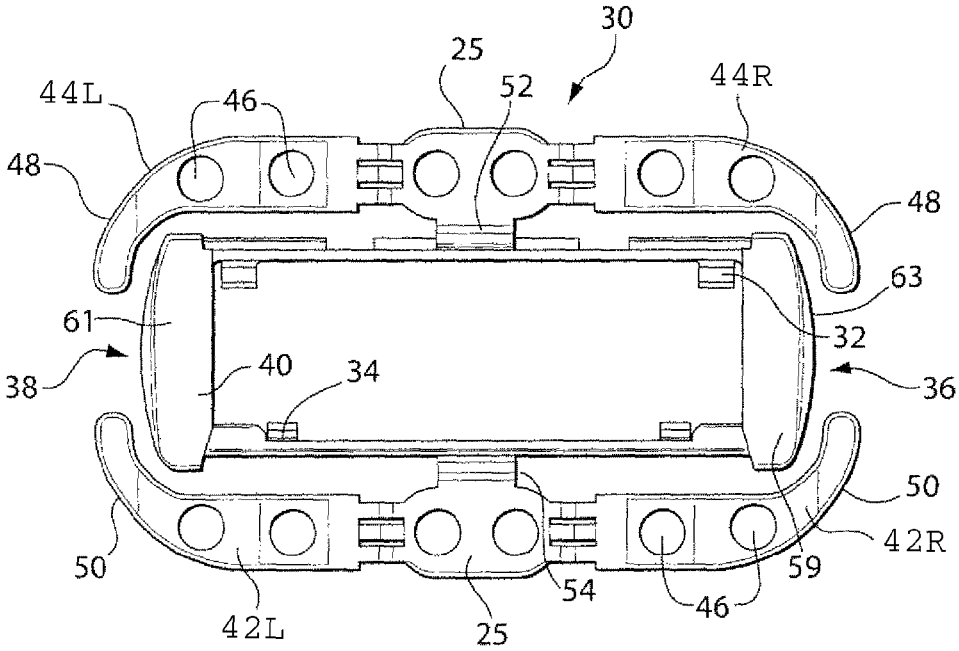
FIG. 3A is a top plan view of the shaving aid holder of the present invention.
Figure 3B:
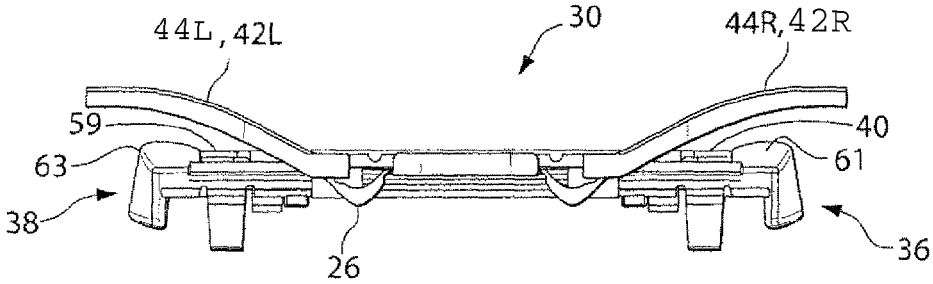
FIG. 3B is a side view of the shaving aid holder of the present invention.
Figure 3C:
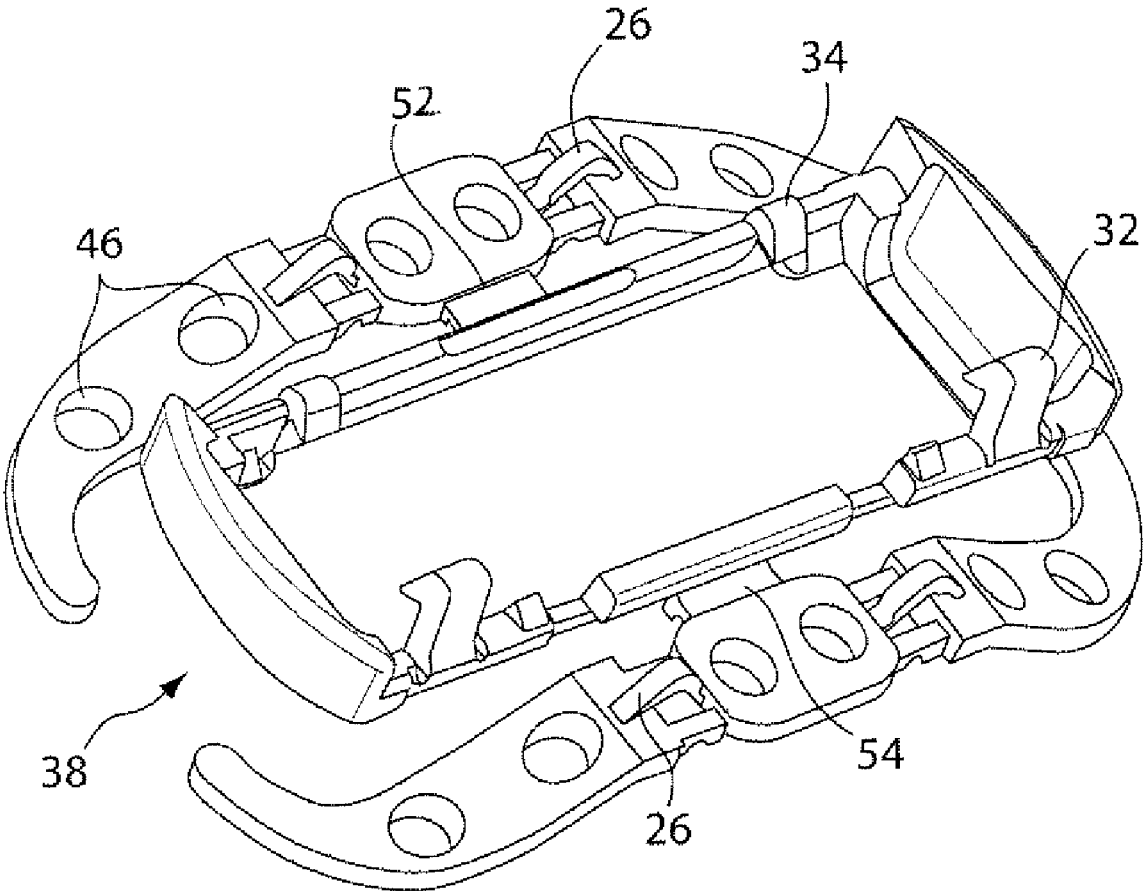
FIG. 3C is a back perspective view of the shaving aid holder.

The shaving aid holder 30 (depicted as underlying the wings) of FIG. 2 comprises a front right wing 42R and a front left wing 42L, both of which are flexibly joined to the central support 25 as well as a rear right wing 44R and a rear left wing 44L, which are also joined to a second central support 25 at the rear of the housing 36. In general as shown by FIG. 2, the shaving aid holder 30 carries a solid shaving aid portion 31A, 31B on one or more portions of the right and/or left wing. In the embodiment of FIGS. 1A-1D, a solid shaving aid portion 31AR, 31AL, 31BR, 31BL is carried on each of the four wings 42R, 42L, 44R, 44L present as well as on the center support of forward and rearward wing pairs making up central support shaving aid portions 31AC and 31BC. In FIG. 2, a front solid shaving aid portion 31A spans and is carried across the width of both the front right and left wings as well a rear solid shaving aid portion spans and is carried across the width of both the rear right and left wings 31B. In FIGS. 3A-3C, the shaving aid holder 30 is depicted without the shaving aid portion 31A, 31B and without the razor blade unit 20 joined to the holder 30. FIG. 3A shows a front and rear right wing 42R, 44R as well as a front and rear left wing 42L, 44L. In FIGS. 1A-1D and 2, corresponding solid shaving aid portions are carried on the respective wings and central supports, e.g., front right shaving aid portion 31AR, front left shaving aid portion 31AL, rear right shaving aid portion 31BR, rear left shaving aid portion 31BL, and front and rear central shaving aid portions 31AC, 31BC. The central support 25is flexibly joined to each of the wings 42R, 42L, 44R, 44L via a wing hinge member 26 which provides biased movement of the wings 42, 44 in a z-direction in response to an applied pressure in the same z-direction.

The razor blade unit 20 comprises at least one razor blade 15 and is similar to blade units described in U.S. Pat. No. 5,661,907. The handle 14 is similar to those described in U.S. Pat. Nos. 5,855,071, 5,956,851 and 6,052,903.

In the embodiment of FIGS. 1A-1D, the front wings 42R, 42L and front central support 25 of the holder 30 carry front shaving aid portions 31AR, 31AC, 31AL and rear wings 44R, 44L and rear central support 25 carry rear shaving aid portions 31BR, 31BC, 31BL. The front shaving aid portions 31AR, 31AC, 31AL contact the skin in front of the blade unit 20, i.e., before shaving, and the rear shaving aid portions 31BR, 31BC, 31BL contact the skin behind the blade unit 20. Thus, the shaving aid portions may have different compositions, for example the front shaving aid portion(s) may include shave preparation ingredients such as lubricants, while the rear portion(s) may include skin soothing and conditioning ingredients such as emollients and moisturizers.

Figure 4A:
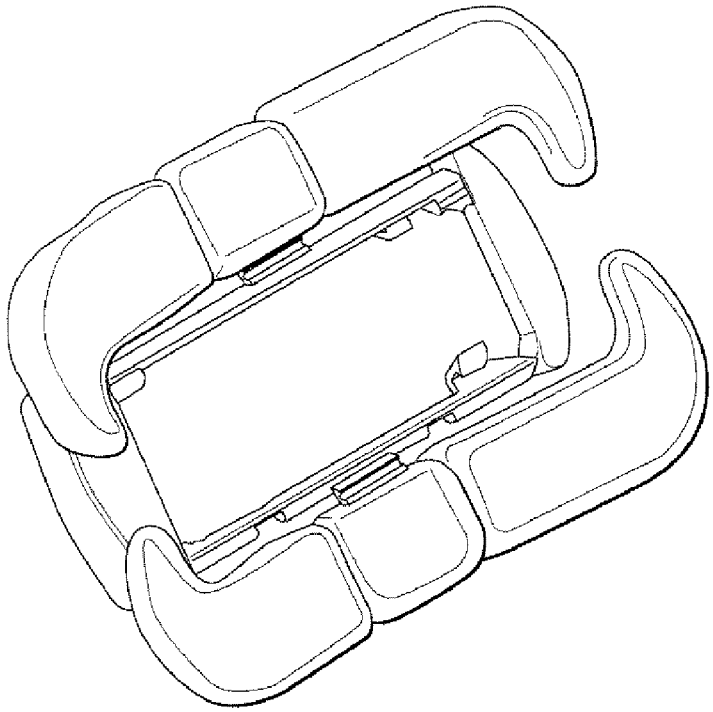
FIG. 4A is a perspective view of an undeflected shaving aid portion and holder of an embodiment of the present invention.
Figure 4B:
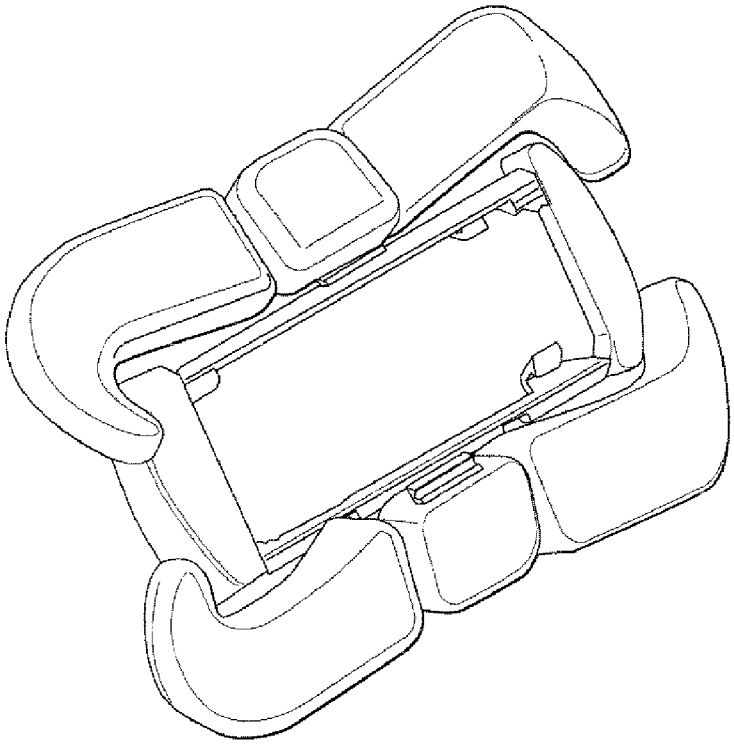
FIG. 4B is a perspective view of a deflected shaving aid portion and holder of an embodiment of the present invention.
Figure 4C:
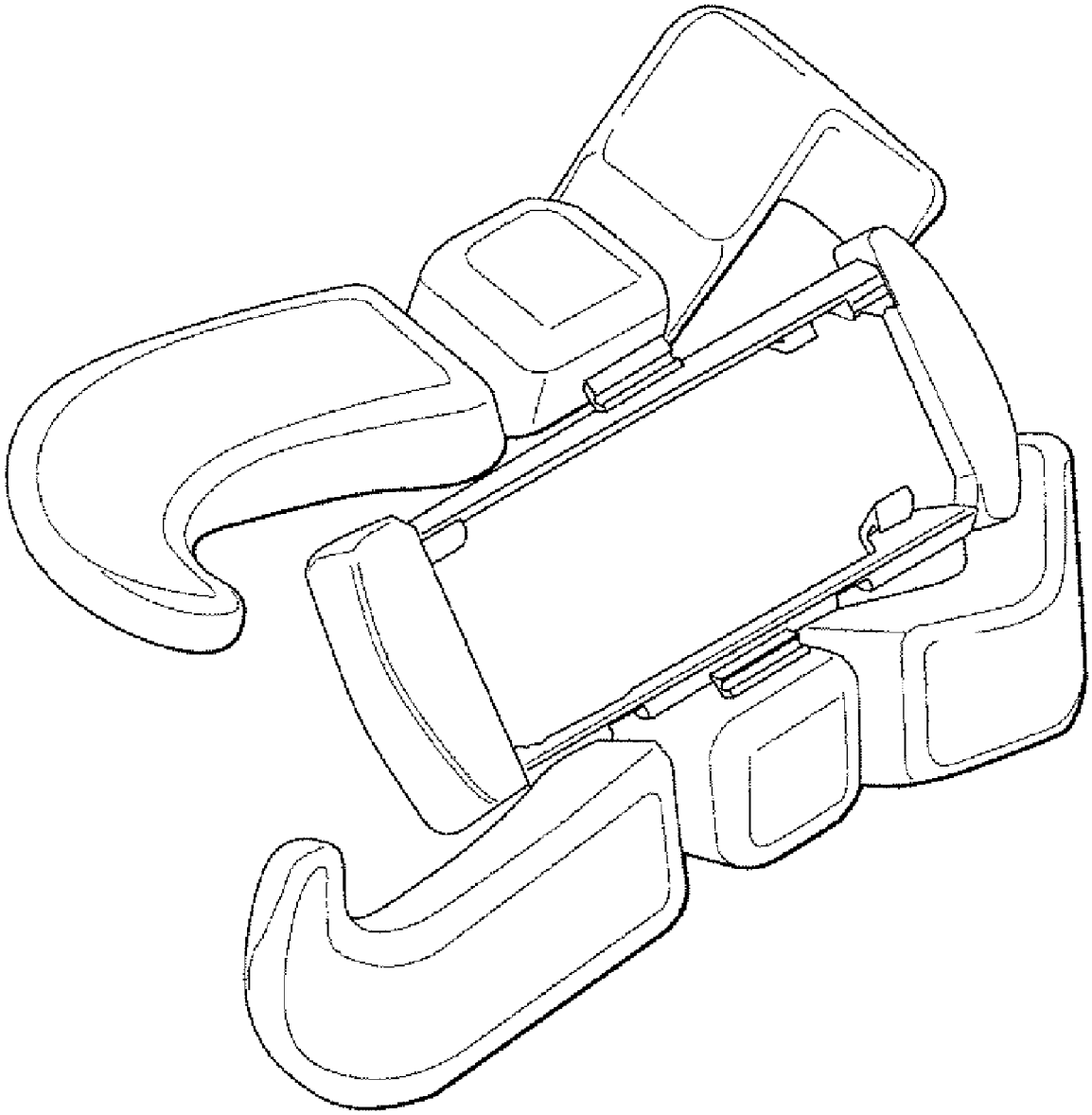
FIG. 4C is a perspective view of a shaving aid portion and holder of FIG. 4A where the deflection is even greater than depicted in FIG. 4B.

The shaving aid portions are mounted so that they will resiliently deflect upon contact with the skin, from a normal, undeflected (concave) position (FIG. 4A) to various flexed positions, two of which are depicted in FIGS. 4B and 4C. This deflection allows the razor to be easily used in hard to reach or confined areas, such as the armpit (axilla) or behind the knee. Deflection of the shaving aid portion also prevents premature wear of the shaving aid portion and discomfort to the user in cases where the user applies excessive pressure during shaving. Preferably, the angle of deflection of the shaving aid portions and underlying wings (depicted in FIGS. 4B and 4C) is at least about 10 degrees, e.g., from about 10 to 60 degrees, typically about 20 to 40 degrees. Generally, the heights of the two shaving aid portions will be proportional to the wear rates of the compositions used, so that the shaving aid portions will be exhausted at approximately the same time.

The holder 30 may be mounted so that it is removable from the blade unit 20 by the consumer (e.g., if the consumer wishes to add a shaving aid holder to a blade unit that does not include one), or, alternatively, may be permanently mounted on the blade unit or integrally molded with the blade unit. In the holder depicted in FIGS. 3A-3C, the holder 30 clips onto the blade unit by engagement of clips 32 and 34 with the back surface 29 of the blade unit 20. The holder 30 may be engaged with the blade unit 20 by sliding the blade unit 20 under clips 34 and then deflecting clips 32 to snap them in place.

Figure 5:
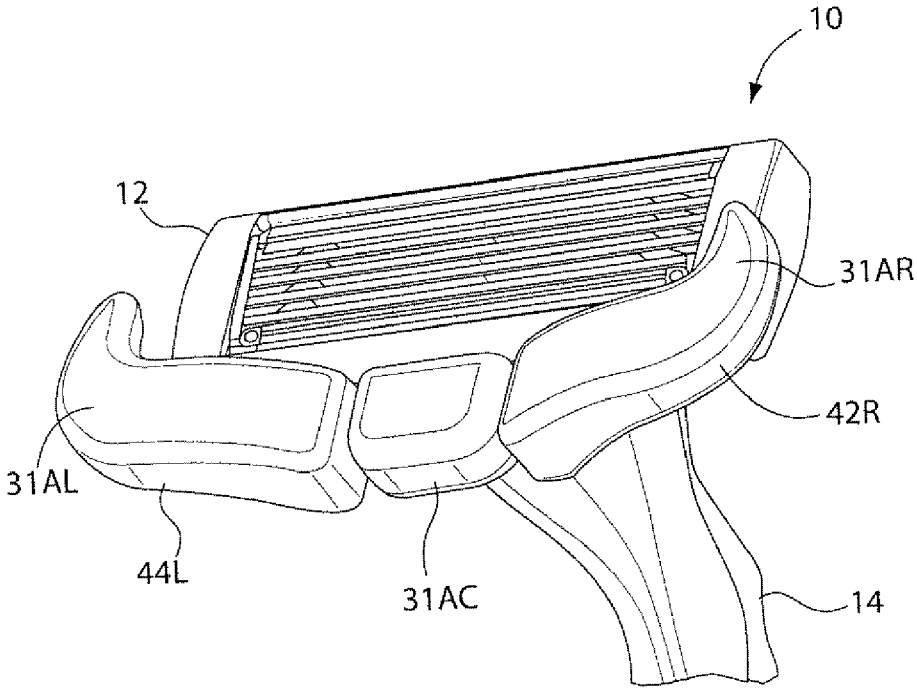
FIG. 5 is a perspective view of a cartridge and a handle portion of a razor according to another embodiment of the invention.
Figure 6:
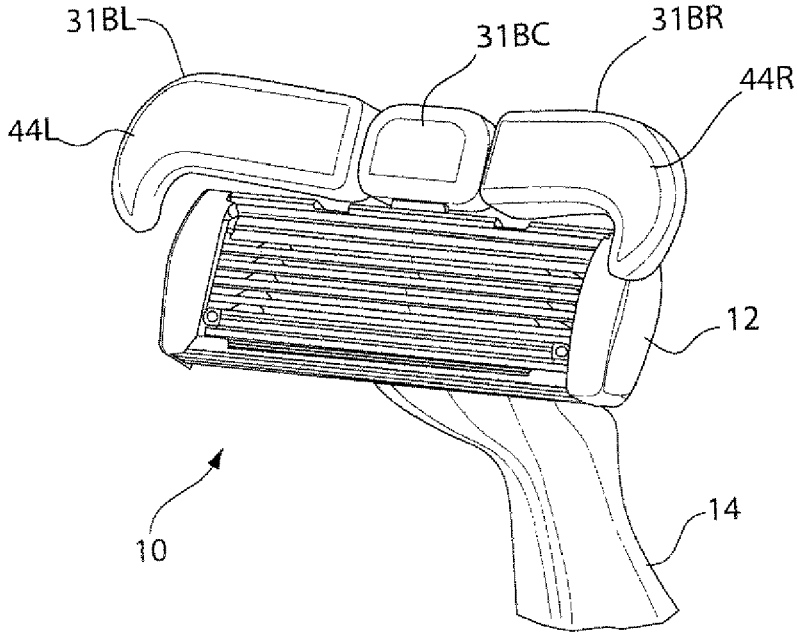
FIG. 6 is a perspective view of a cartridge and a handle portion of a razor according to another embodiment of the invention.

In another embodiment of the present invention, the shaving aid holder 30 of FIG. 5 comprises only a front right wing 42R and a front left wing 42L, both of which are flexibly joined to the central support 25. Thus, this embodiment only includes a front right shaving aid portion 31AR and a front left shaving aid portion 31AL on such wings as well as on the center support of the front or forward wing pairs making up a front center shaving aid portion 31AC. Conversely, another embodiment of the present invention that is shown in FIG. 6 includes only a rear right wing 44R and a rear left wing 44L, both of which are also flexibly joined to the central support 25. This embodiment includes a rear right shaving aid portion 31BR, a rear center shaving aid portion 31BC, and a rear left shaving aid portion 31BL.

Various features of the cartridge 12 will now be described in further detail.

Structure of the Shaving Aid Holder

Referring to FIGS. 3A-3C, shaving aid holder 30 includes a housing 36 that extends around the periphery of the cartridge body when the holder 30 is in place. Generally, housing 36 is formed of a molded plastic. Preferably, the sides 38 of the housing extend over side regions of the blade unit 20, to securely hold the holder 30 in place. Sides 38 should generally be sufficiently thin, adjacent the blade ends, so that shaving performance is not compromised. Preferably, a ramped area is provided between the very thin edges 40 adjacent the blade ends to an area outboard of the edges. For example, the sides 38 generally have a thickness of less than 0.15 mm at edges 40 and about 0.5 mm inboard of edges 40. This ramped area 59 provides rails 61, between line L and the outer side edge 63 of the holder 30. These rails 61 may enhance tracking of the razor during use.

Referring to FIG. 2, shaving aid portions 31A and 31B are each carried on a pair of right and left wings 42, 44 (corresponding to 42R, 42L, 44R, and 44L in FIG. 1). Wings 42, 44 may be formed of the same plastic as the frame, or may be formed of a different material. For example, the wings may be formed of the same material as the central support hinges 52, 54 (FIG. 3) that join the central support 25 to the housing. In this case, the central support 25, wings 42, 44 and hinges may be overmolded onto the housing in a single molding step.

The wings may or may not include a plurality of apertures 46 (FIG. 3A) that allow the shaving aid to flow through the thickness of the wing and form a mechanical interlock (e.g., by flowing together to form a unitary mass) on the back side of the wing, securing the shaving aid to the wing.

Elastomeric bumpers 48, 50 may be provided at the corners of the wings, underlying the shaving aid portions, so that as the shaving aid portions are exhausted the user's skin will contact elastomer rather than hard plastic. Generally, the elastomeric bumpers have a thickness of at least 1 mm, e.g., about 1.5 to 3 mm. The elastomer may be relatively soft for user comfort and so that the hinge will have a soft flex. For example, the elastomer may have a hardness of less than about 50 Shore A, e.g., less than about 40 Shore A. The elastomer may be, for example, a block copolymer such as those available under the tradename KRATON. In certain instances, the elastomer has sufficient chemical resistance so that it will not degrade during prolonged contact with the ingredients of the shaving aid composition.

Referring to FIG. 3B, even in their normal, undeflected position, the wings 42R, 42L, 44R, 44L curve upward, well above the plane defined by the blade edges. This concave curvature allows the wings to carry a relatively large amount of soap but still conform comfortably to the consumer's skin contours during shaving.

Resilient Mounting of Shaving Aid Portions

Wings 42, 44 are resiliently mounted on the housing 36, to allow deflection of the shaving aid portions 31A, 31B during shaving, from the normal position shown in FIG. 4A to various deflected positions (two of which are shown in FIGS. 4B and 4C. Flexible central support hinges 52, 54 (FIG. 3A) provide this resilient connection between the central support and the housing.

Hinges 52, 54 may be formed of an elastomeric material, e.g., a block copolymer. The hinges may be formed of the same elastomeric material as the elastomeric bumpers 48, 50 discussed above. The elastomeric material is generally selected to provide a soft flex, so that the wings deflect readily upon contact with the user's skin, while also providing a good spring return to the wings. For example, the elastomeric material may have a flexural modulus of about 100 to 300 psi. The modulus that will provide the desired product characteristics will depend upon the thickness T and length of the hinges. The thickness and length of two opposing central support hinges can be the same or different, and these dimensions and the elastomeric material used can be selected to give the two pairs of wings desired flexural characteristics. Recall, it is quite possible for an embodiment of the present invention to include a single central support with a single pair of wings either before or after the blade unit. In any event, the thickness of the hinges may be, for example, from about 0.1 to 2.0 mm and the length may be from about 0.1 to 3.0 mm. In the embodiment shown in FIG. 3, the central support hinge is disposed along the central region of the housing. It is possible, however, if desired, to narrow or lengthen the hinges along the housing's length. Alternatively, the central support hinges may repeat along the length of the housing to provide a discontinuous hinge system along one or both of the rear and/or front edges.

The central support hinges 52, 54 may be overmolded onto the housing. In such an embodiment, the housing is connected to each of the wings by one or more connecting members that extend integrally from the housing to the wings, particularly in the vicinity of the sides 38. If desired, these connecting members may be cut after overmolding has been completed. Alternatively, the wings and housing may be separate components that are placed in an insert mold and overmolded with elastomer. Forming the hinges solely of elastomer (i.e., substantially free of rigid plastic) may result in a softer flexing hinge in some cases.

Pivoting Cartridge/Handle Connection

As discussed above, referring to FIGS. 1A-1D, 2, 5 and 6, razor 10 includes a disposable cartridge 12 and a handle 14. A cartridge 12 may include a connecting member (which is not shown), which may removably connect cartridge 12 to a connecting portion (not shown) of handle 14, and a blade unit 20, which is pivotally connected to the connecting member. The interaction of the components of handle 14 and cartridge 12 during connection and disconnection of cartridge 12 to handle 14 is discussed in further detail in U.S. Pat. No. 5,956,851, the disclosure of which is incorporated by reference above.

Shaving Aid Formulations

Any desired formulation may be used to form the shaving aid portions. In certain embodiments, the shaving aid portions have sufficient wear resistance so that the shaving aid portions last for the intended life of the cartridge. If desired, the shaving aid holder may be removable and replaceable by the consumer, in which case the shaving aid portions may be exhausted before it is necessary to replace the cartridge.

In some instances, the shaving aid portions may include soap, e.g., poured or extruded soap. Such soap-based compositions may be modified to increase their hardness, wear resistance, lubricity and/or skin moisturizing and conditioning properties.

Wear Indicators

If desired, the shaving aid portions may serve as a wear indicator, indicating to the user when the cartridge should be replaced. The shaving aid portions can be formulated to be exhausted at the end of the intended life of the cartridge, as discussed above, so that running out of shaving aid will indicate to the user that the cartridge should be replaced. In other implementations, the shaving aid portions may include an embedded indicia, e.g., a logo, design, or word, that appears when a predetermined amount of shaving aid has been washed away, or an indicia may be embossed on the shaving aid, which disappears as the shaving aid is used. In these cases, appearance or disappearance, respectively, of the indicia would indicate to the user that the cartridge should be replaced. Similarly, a lubricating strip may be mounted on one or both of the wings, underlying the shaving aid portion (s) or even adjacent to the shaving aid portion(s), either after the front shaving aid portion or before the rear one. In this case, as the shaving aid is exhausted the lubricating strip will be revealed, indicating that the cartridge should be replaced. The lubricating strip will provide the added benefit of lubrication and skin conditioning during the period of time until the user is able to replace the cartridge.

Other Embodiments

Other embodiments are within the scope of the following claims. For example, while particular cartridge and handle types have been discussed above, the shaving aid holder may be used with any desired type of cartridge and/or handle. If a different cartridge shape is used, the shape of the frame of the shaving aid holder and/or the dimensions of the shaving aid holder may be adjusted accordingly.

Moreover, while two shaving aid portions are shown in the figures and described above, if desired the shaving aid holder may include only a single shaving aid portion, e.g., the front shaving aid portion if only a shave preparation composition is desired, or the rear portion if only skin conditioning is desired (for example, if the user will be using a separate shave preparation such as a bar of soap or a shave gel). In this case, the shaving aid holder will generally include only a single pair of front or rear wings and a single central support.

Additionally, while the wings described above include apertures to secure the shaving aid in place, solid wings may be used if the shaving aid exhibits adequate adhesion to the wings or is attached to the wings in a different manner. Also, while the central support hinges described above are formed of an elastomeric material, in some cases the hinges may be formed of rigid plastic, e.g., "living hinges."

In some embodiments, the cartridge may include a cap with a lubricating strip, e.g., mounted in a slot at the rear of the cartridge housing. The lubricating strip may be made of a material comprising a mixture of a hydrophobic material and a water leachable hydrophilic polymer material, as is known in the art and described, e.g., in U.S. Pat. Nos. 5,113,585 and 5,454,164.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A disposable razor cartridge comprising:

a. a blade unit comprising a razor blade;

b. a shaving aid holder joined to said blade unit, said holder comprising 1) a blade unit housing surrounding said blade unit, said housing having front and rear edges;

2) a central support flexibly joined to one of said front and rear edges of said housing;

3) a right wing and a left wing, both wings being independently and flexibly joined to said central support such that both wings are disposed in front of the front edge or rear of the rear edge; and wherein said holder carries at least one solid shaving aid portion on one or more of said wings and wherein said right and left wings exhibit biased movement in a z-direction in response to an applied pressure in the z-direction.

2. A shaving razor comprising:

a. a handle having a proximate and distal end;

b. a disposable razor cartridge mounted at the proximate end of said handle, said cartridge further comprising 1) a blade unit comprising a razor blade;

2) a shaving aid holder joined to said blade unit, said holder comprising a) a housing surrounding said blade unit, said housing having front and rear edges;

b) a central support flexibly joined to one of said front and rear edges of said housing;

c) a right wing and a left wing, both wings being independently and flexibly joined to said central support such that both wings are disposed in front of the front edge or rear of the rear edge; and wherein said holder carries at least one solid shaving aid portion on one or more of said wings and wherein said right and left wings exhibit biased movement in a z-direction in response to an applied pressure in the z-direction.

3. The shaving razor of claim 2 wherein said cartridge is removably mounted to said handle.

4. The shaving razor of claim 2 wherein said cartridge comprises a plurality of blades.

5. The shaving razor of claim 2 wherein said right wing is joined to said central support via a first biased hinge and said left wing is joined to said central support via a second biased hinge.

6. The shaving razor of claim 5 wherein said first and second biased hinges bias said right and left wings, respectively, toward a top surface of said cartridge.

7. The shaving razor of claim 5 wherein said first biased hinge is integrally formed with said central support and said right wing and said second biased hinge is integrally formed with said central support and said left wing.

8. The shaving razor of claim 5 wherein said biased hinges comprise an elastomeric material to promote biasing.

9. The shaving razor of claim 2 wherein said holder carries a solid shaving aid portion at said front edge or said rear edge.

10. The shaving razor of claim 9 wherein each of the right and left wings include a plurality of apertures such that said solid shaving aid portion is configured to flow through said plurality of apertures to form a mechanical interlock and to secure said solid shaving aid portion to the right and left wings.

11. The shaving razor of claim 2 which comprises an additional central support that is flexibly joined to said housing.

12. The shaving razor of claim 2 wherein each of the right and left wings include elastomeric bumpers at a distal end of the wings.

13. The shaving razor of claim 2, wherein the right and left wings curve upward when no pressure is applied to the right and left wings.

14. The shaving razor of claim 13, wherein the right and left wings form an upward concave curvature.

15. A method of shaving hair from skin comprising the steps of:

a. contacting a surface of the skin with a disposable razor cartridge comprising
   1) a blade unit comprising a razor blade;
   2) a shaving aid holder joined to said blade unit, said holder comprising
      a) housing surrounding said blade unit, said housing having front and rear edges;
      b) a central support flexibly joined to one of said front and rear edges of said housing;
      c) a right wing and a left wing, both wings being independently and flexibly joined to said central support such that both wings are disposed in front of the front edge or rear of the rear edge and wherein said holder carries at least one solid shaving aid portion on one or more of said wings and wherein said right and left wings exhibit biased movement in a z-direction in response to an applied pressure in the z-direction.

b. applying pressure in the z-direction to the surface of the skin; and c. moving said razor cartridge along the surface of the skin.

16. The method of claim 15 further comprising the step of wetting the surface of the skin prior to contacting the surface of the skin with the razor cartridge.

* * * * *